US005733088A

United States Patent [19]

Kerrien et al.

[11] Patent Number: 5,733,088

[45] Date of Patent: Mar. 31, 1998

[54] PACKAGING AND STORAGE CONTAINERS, ESPECIALLY FOR REMOTE-HANDLED HAZARDOUS WASTE, AND PROCESS FOR FILLING THEM

[75] Inventors: Philippe Kerrien, Montigny le Bretonneux; Franck Tricot, Plaisir, both of France

[73] Assignee: Compagnie Generale des Matieres Nucleaires, Vellzy-Villacoublay, France

[21] Appl. No.: 741,939

[22] Filed: Oct. 31, 1996

[30] Foreign Application Priority Data

Nov. 15, 1995 [FR] France ..... 95 13517

[51] Int. Cl.[6] ..... G21F 9/36

[52] U.S. Cl. ..... 414/146; 588/15; 588/16; 376/272; 53/244; 53/248; 53/475; 414/293; 220/440; 220/441

[58] Field of Search ..... 414/146, 293, 414/792.7; 220/438, 440–442; 588/15, 16; 376/272; 53/244, 248, 475; 100/73, 92, 219; 141/1, 100, 284, 390

[56] References Cited

U.S. PATENT DOCUMENTS

| | | | |
|---|---|---|---|
| 843,325 | 2/1907 | Canfield | 53/475 |
| 939,021 | 11/1909 | Hendrix | 220/441 |
| 2,695,126 | 11/1954 | Russell | 220/441 |
| 3,405,744 | 10/1968 | Bowman | 141/390 |
| 3,650,120 | 3/1972 | Harza | 100/73 |
| 3,710,543 | 1/1973 | Toss | 53/244 |
| 3,778,965 | 12/1973 | O'Lenick et al. | 53/248 |
| 3,842,573 | 10/1974 | Price | 53/475 |
| 4,554,868 | 11/1985 | Zimmer | 141/390 |
| 4,642,204 | 2/1987 | Burstrom et al. | 588/11 |
| 4,645,624 | 2/1987 | Ramm et al. | 588/16 |
| 4,683,110 | 7/1987 | Baudro et al. | 376/261 |
| 4,760,784 | 8/1988 | Whiteside | 100/219 |
| 4,800,703 | 1/1989 | Goodman | 53/244 |
| 4,822,555 | 4/1989 | Kawabata | 376/272 |
| 5,592,027 | 1/1997 | Jacq et al. | 588/16 |

FOREIGN PATENT DOCUMENTS

| | | | |
|---|---|---|---|
| 0 044 381 | 1/1982 | European Pat. Off. | 588/16 |
| 0 347 312 | 12/1989 | European Pat. Off. . | |
| 62-017699 | 1/1987 | Japan . | |
| 2067998 | 7/1990 | Japan . | |
| WO 94 16449 | 7/1994 | WIPO . | |

*Primary Examiner*—J. Casimer Jacyna
*Attorney, Agent, or Firm*—Fish & Richardson P.C.

[57] ABSTRACT

The disclosure relates to packaging and storage containers suitable particularly for the packaging and storage, with optimum filling, of remote-handled hazardous waste; a process for filling the containers; and the implementation of the process for the packaging and storage of compacted nuclear waste. The containers are equipped inside, along one or more axial walls, over substantially the whole of their height h, with locking elements capable of undergoing elastic radial deformation on direct contact with the products introduced therein, the locking elements allowing the introduction and movement of products inside the containers only when force is applied to the products.

21 Claims, 3 Drawing Sheets

Figure 1:
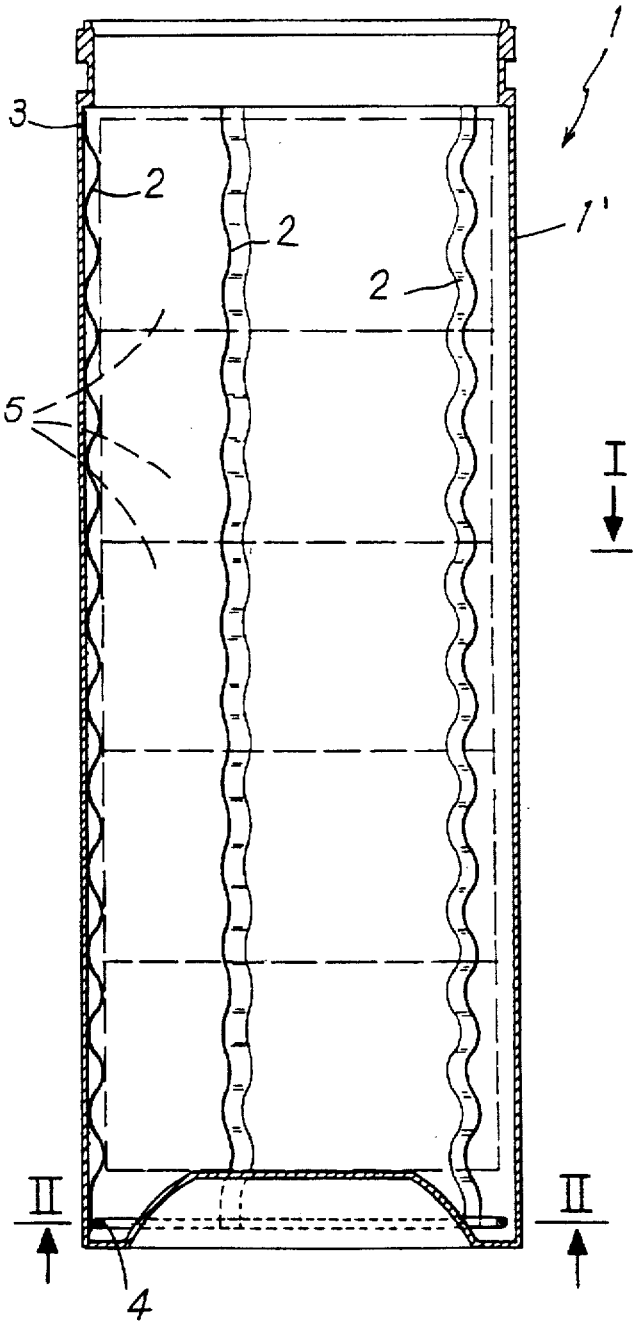

PACKAGING AND STORAGE CONTAINERS, ESPECIALLY FOR REMOTE-HANDLED HAZARDOUS WASTE, AND PROCESS FOR FILLING THEM

The present invention relates primarily to packaging and storage containers. Said containers are particularly suitable for the packaging and storage, with optimum filling, of remote-handled hazardous waste.

The present invention further relates to a process for filling said containers and to its implementation for the packaging and storage of compacted nuclear waste.

Said invention will be described more particularly in this nuclear context insofar as it was developed especially for that purpose; however, from the description which follows, those skilled in the art will easily understand that it is not limited to this context. The claimed containers are suitable for the optimized packaging and storage of any type of material and especially for materials which are difficult to handle, such as explosive, toxic, radioactive and other materials, the optimization pertaining both to the filling volume (it is desirable to minimize the bulk) and to the stability of the stored materials.

The shells and end-pieces resulting from the chopping-up of nuclear fuel assemblies (said chopping process has been described especially in patent application EP-A-347 312) have hitherto been placed in the same drum, specific for this type of high level waste, on leaving their respective rinsers. They are then coated, as such, with a cement slurry. Said slurry is poured into the drum until it is full to the brim. After a safety lid has been welded on, the filled drams are transferred directly to a storage facility.

In order to reduce the volume of this waste considerably, it was decided to compact it. A proposed compaction process has been described especially in patent application WO-A-94 16449. The desired procedure is actually as follows: fill an approximately 80-liter cylindrical case with shells and end-pieces, compact said filled case with a press and package this new compacted waste in a container of the same geometry as containers for vitrified fission products, which are called high level containers or HLC. Such containers (cylinders of revolution) have a useful height of about 1 m and a useful internal diameter of about 40 cm. The intention is to stack 5 to 8 blocks of compacted waste in one HLC, depending on their height. Said blocks of compacted waste generally take the form of cylinders whose diameter is slightly less than the useful internal diameter of the HLC. Said blocks of waste can vary in weight, being especially of the order of 100 kg. In fact, two dimensions of the HLC have to be taken into account: on the one hand its internal diameter, which governs the diameter of the blocks of compacted waste and of the means of introducing said blocks of waste into said HLC, and on the other hand its useful height, which governs the number of said blocks of waste which may be packaged in said HLC.

Thus the problems of introducing said compacted waste into the HLC and locking it therein arose in this context.

The inventors had the task of designing a system for filling HLCs with said compacted waste and for locking said waste inside said HLCs, said system being capable of:

limiting or even preventing any damage to the inner envelope (wall(s), bottom) of the HLC while it is being filled, as well as during the handling and transportation stages of said HLC; and ensuring that the geometric positioning of the compacted waste inside the HLC is stable, while at the same time losing the minimum volume of said HLC.

In fact, said filling and locking system must:

enable the blocks of compacted waste to be introduced lengthwise into the HLC, one after the other, the nature of said waste being such that it is remote-handled in a cell;

prevent them from falling inside said HLC under gravity;

ensure that they are stacked lengthwise; and limit their movement in the HLC once they have been inserted.

As regards the introduction of said waste into said HLC, the means involved are limited. In fact, the relatively heavy weight of a block of compacted waste and the small difference between its diameter and the minimum internal diameter of the HLC are such that said block of waste cannot be placed directly on the bottom of said HLC by a conventional mechanical means such as a clamp. Furthermore, the composition of the compacted waste in terms of the material (insufficient weight of ferromagnetic material relative to the total weight of the waste) and its surface condition do not allow it to be handled with an electromagnet. Also, the use of an electromagnet would itself present a problem in terms of the safety of the process.

Faced with the specific technical problem described above, the inventors have developed novel packaging and storage containers and a process for filling said containers.

Such containers are of the HLC type in the context described above; as indicated previously, however, the present invention is not limited to said context.

It relates in general terms to containers of cylindrical or prismatic shape and of height h which are open or capable of being opened at their upper axial end in order to be filled. In principle, said containers, which are of conventional shape (their shape is actually adapted to that of the materials to be stored inside them), have a bottom (capable of supporting the weight of the stored materials) at their lower axial end and are destined to be filled, in conventional manner, through their upper axial end. They can have a (removable) lid at said upper axial end.

Said containers are generally of cylindrical shape, advantageously of circular cross-section (they therefore advantageously consist of cylinders of revolution of the HLC type), but it is entirely possible, according to variants of the invention, for them to be of prismatic shape (they then advantageously consist of parallelepipeds), of cylindrical shape whose cross-section is a portion of a circle, and so on. In fact, as will easily be understood when considering the characteristics of the invention specified below, said characteristics can be incorporated into the structure of any type of container according to the prior art.

A totally novel feature of the containers according to the invention is that they are equipped inside, along their axial wall(s), over substantially the whole of their height, with locking means capable of undergoing elastic radial deformation on direct contact with the products introduced therein, said locking means allowing the introduction and movement of said products inside said containers only when force is applied to said products (only by force).

Said locking means capable of undergoing elastic radial deformation, which may more simply be described as elastic means, constitute the key elements or the essential constituent means of the present invention. They are located inside the container, along its axial wall(s).

In the present text and the claims appended thereto, axial wall(s) of the container is (are) understood as meaning the lateral wall(s) of said container, parallel to its axis.

Said locking means generally consist of separate parts. The solution recommended by the invention for solving the technical problem of the packaging and storage of materials with optimum filling is of particular value in this respect. What is proposed is not containers of a complex structure, but the simple addition of unsophisticated means to containers of the prior art, said addition causing no real loss of storage volume (the elastic means only cutting into the internal volume of the container to the minimum extent).

Said elastic means must exist and be able to exert their action over the whole filling height. They must deform such that the products to be stored are inserted by force without the risk of falling under gravity (through an appreciable distance, or indeed through any distance at all), whether or not said products are accompanied to the bottom of the container by handling means (it has been seen that in the case of compacted nuclear waste to be packed in an HLC, it is a priori excluded to place said waste directly on the bottom of the container), and they must also ensure that said inserted products are locked in place. Said elastic means are caused to deform on direct contact with the products to be stored, or stored products, by friction therewith. Real friction is observed when the product is forcibly inserted (at the packaging stage) in the container (insofar as said product is then being moved relative to said container) and contact is ultimately observed (at the storage stage).

Whatever the case may be, the locking means with which the containers of the invention are equipped must prevent any movement of the products introduced totally or partially into said containers, under the action of their own weight or when said containers are being handled or transported. However, their elasticity must be such as to allow such movements (progressive insertion of said products) under the action of an appropriate thrust exerted on said products, especially when said containers are being filled.

It will obviously be understood that said locking means can only perform their function (locking) if the products have a cylindrical or prismatic shape corresponding to that of the container, and appropriate dimensions (appropriate cross-section and height for preventing the products from falling, especially sideways).

Said locking means with which the containers of the invention are equipped, as a characteristic feature, also constitute means of protecting the inner envelope (wall(s), bottom) of said containers. They preserve said inner envelope by limiting or even preventing any impact between it and the products to be stored, or stored products, both while the containers are being filled and while they are being handled and transported. By optimization of their number and their distribution, said locking means can ensure perfect centering of the stored products; this is particularly advantageous, as specified below.

Advantageously, said locking means or elastic means are uniformly distributed over the inner face of the axial wall(s) of the container. The purpose of this is especially to preserve the inner envelope of said container to the greatest possible extent, in particular by limiting the jolts during packaging, and to center the stored products, in particular so as to spread the forces uniformly. It is for this reason that in the case of a container of prismatic shape, it is advantageous to have said elastic means on all the axial walls of said container. Likewise, if said means do not extend continuously over the whole height of the container, it is advantageous to have several of them uniformly spaced out over said height.

Said elastic means can exist in different variants. In particular, they can consist of springs or spring elements. They can also consist of abutments made of an elastomeric material.

In one advantageous embodiment of the present invention, they consist of corrugated flat springs or strips in which the corrugations extend along their length and which are held in a substantially vertical position along the axial wall(s) of the container.

Such strips must exert their action over the whole filling height. It is possible to have several such strips, shorter than said filling height, fixed at different levels inside the container. In one preferred variant, each of said strips is sufficiently long to cover the whole filling height.

It is therefore advantageous to have at least two and preferably at least three springs of this type in the containers of the invention, their length corresponding to the filling height. Said two springs advantageously face each other. In a cylindrical container of circular cross-section, said two springs are thus advantageously diametrically opposite one another. In general, in such a cylindrical container of circular cross-section, there are advantageously n springs of this type, $2\pi/n$ apart ($n \geqq 2$, preferably $n \geqq 3$). In a prismatic container (of polygonal cross-section), there is advantageously at least one spring of this type on each wall (i.e. $n \geqq 3$) and, even more advantageously, said springs are distributed symmetrically. Those skilled in the art will readily appreciate the value of a symmetrical distribution of said springs, the aim being to optimize the centering and the stability of the stored products and the protection of the inner envelope of the containers of the invention.

Within the structure of the containers of the invention, said springs are held in a substantially vertical position along the axial wall(s). They can thus exert their action over the whole filling height. They are generally held in this substantially vertical position by being joined to the container at the top.

It is by no means essential for this position to be perfectly vertical. In fact, it is observed that the insertion of the products in the container (positioning of said products by force) virtually constrains said flat springs, fixed at the top, to adopt the vertical position. Said springs then find themselves pinned against the wall(s) of said container.

Within the framework of this preferred embodiment of the invention, therefore, there are corrugated flat springs inside the containers, said springs being fixed at the top and their length corresponding to the filling height. Said flat springs may perfectly well remain totally free at their opposite end, near the bottom of the container. In other embodiments, they can also be joined together at the bottom, for example by a free torus. The use of such a means facilitates the fixing of said springs inside the container and holds said springs against the wall(s) of said container. Whatever the case may be, said springs have a space at the bottom, enabling them to extend when undergoing elastic deformation.

Within the framework of this preferred embodiment of the invention, the parameter "dimensions of the corrugations in the flat springs used" is available for adapting the locking force to the products to be introduced into the containers and stored therein.

It has also been seen that, in other embodiments of the present invention, the locking means capable of undergoing elastic radial deformation can consist of spring elements ("small pieces"). These can be elements of flat springs joined to the container by only one end or by both ends. Said spring elements are arranged so as to exert their action by radial deformation.

Whatever the variant of the locking means capable of undergoing elastic radial deformation, they generally consist of separate parts which have been fixed to the inside of the container. The most common situation is to have metal parts—locking means and containers—which are welded together.

The first object of the present invention is therefore to provide novel containers, the value of which will be obvious to those skilled in the art. The specific internal arrangement of said containers enables them to be filled with hazardous products (explosive, toxic, radioactive and other products), even when remote-handled.

The filling of said containers constitutes the second object of the present invention. It is obvious that, in general terms, the use of said containers is included within the framework of the present invention, but that the value of said containers is more evident in the context of remote handling, with handling means, of the products or objects to be packaged and stored inside said containers.

Said products have a cylindrical or prismatic shape corresponding to that of the container inside which they are to be stored, and a height h' which is less than or equal to the height h of said container. The aim is obviously to store at least one product inside a container. The aim is generally to store n products of height h' ($h \geqq nh'$) on top of one another. A further condition will be $h' > h'_{minimum}$ in order to avoid any possibility of the product falling sideways under gravity inside the container. With knowledge of the dimensions of the respective cross-sections of the product and the container, those skilled in the art will know how to calculate $h'_{minimum}$.

The correspondence between the shapes of the products and the container for packaging and storing said products ensures that the loss of storage volume is minimized and that said products are locked inside said container by the action of the locking means. However, it must allow said products to be introduced into said container.

The process of filling a container of the invention with such products or objects comprises:

handling said products with handling means; and introducing them into said container and positioning them therein by the application of force (by force) using said handling means, if necessary in cooperation with complementary means, the force developed being sufficient to overcome the frictional forces exerted by the locking means.

Said filling process can be carried out according to different variants. It is easy to carry out if the products to be stored can be placed directly in their "definitive" storage position with the means of handling said products. It is more complicated to carry out if said objects can only be placed in their "definitive" storage position in several stages, and if it is necessary to involve complementary means for this purpose. Everything actually depends on the characteristics (weight, nature, etc.) of the products to be handled.

The process of the invention can ultimately be carried out using any suitable handling means such as mechanical means (for example clamps), suckers, electromagnets, etc. It is pointed out here, in passing, that electromagnets would not be suitable for handling compacted nuclear waste. With the appropriate handling means for said handling of the products, it is then necessary to consider whether or not they can be introduced into the container. A clamp can not. Said handling means, and any complementary means involved, must be capable of pushing the products inside the containers, i.e. of transmitting the force required to drive said products into said containers.

Two main variants of the filling process have been developed within the framework of the present invention. These two variants are not exhaustive.

In the first variant, the products to be stored are handled with handling means such as suckers or electromagnets—means which can be introduced into the container and therefore allow said products to be positioned directly inside said container. The first of said products is introduced into the container and positioned directly at the bottom of said container with said handling means; any further product(s) is (are) then introduced and positioned on the previous product (successively, one on top of the other) in the same manner. Provision is obviously made for such handling means to be able to exert a sufficient force on said products to overcome the frictional forces exerted by the locking means. It is thus possible to place each product directly in its definitive storage position. Alternatively, provision can be made to position successive products approximately and then apply a sufficient force to bring them all into their definitive position when the last product is being positioned, or at some time thereafter.

In the second variant of the filling process claimed in the present patent application, the products to be stored are handled with suitable handling means such as suckers, electromagnets or clamps—means which may or may not be introduced into the container but which, in the present variant of the process, are not introduced therein under any circumstances—and are positioned in the container in several stages.

In a first stage, using said handling means, the products to be stored are introduced partially into said container. They are actually placed stably in the top of said container, the stability being acquired by virtue of the locking means. They are then released from their handling means and held in stable equilibrium, again by the locking means with which the container is equipped. Finally, they are introduced completely into said container under the action of other means such as a ram. With the handling means retracted, other complementary means come into play. Said other means or complementary means push each of said products into its final storage position in a single operation or push each product a short distance with the sole purpose of freeing the mouth of the container for the introduction of the next product. In the latter case, the stack of products which builds up is jolted down en bloc into its final storage position.

In this variant of the process of the invention, each product is positioned in several steps (at least 2). This variant of the process of the invention is advantageously carried out with mechanical handling means such as clamps. It is perfectly suitable for filling an HLC-type container with compacted nuclear waste.

In general terms, the process of the invention as described above is advantageously used for the packaging and storage of compacted nuclear waste. It is described in greater detail in this nuclear context with reference to the attached FIGS. 3*a* to 3*f*.

It is pointed out here that the process according to the invention for filling containers possessing the novel characteristics specified above can be used in other contexts with the means described above, which cooperate with other means in more or less complex systems.

The invention is now described with reference to the attached Figures.

Figure 2:
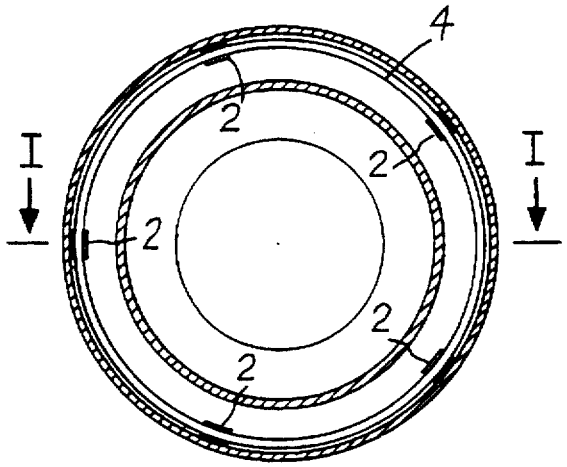

FIGS. 1 and 2 show a container of the invention. FIG. 1 is a longitudinal section along I—I of FIG. 2; said FIG. 2 is a section along II—II of said FIG. 1. Said container is shown "full".

FIGS. 3*a* to 3*f* illustrate one way of carrying out the process for filling a container of the invention (block diagram).

Figure 4:
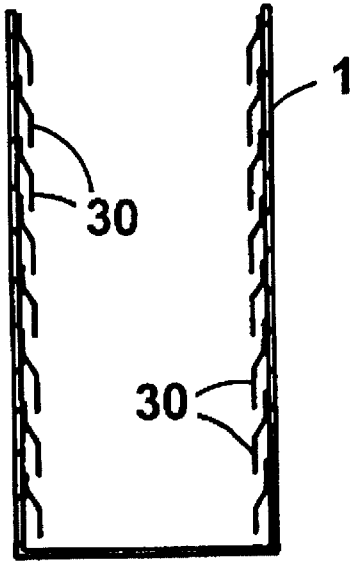

FIG. 4 shows another container of the invention.

Figure 5B:
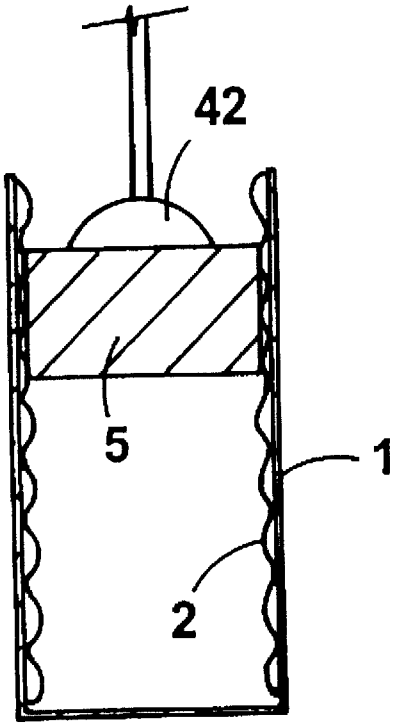
Figure 5A:
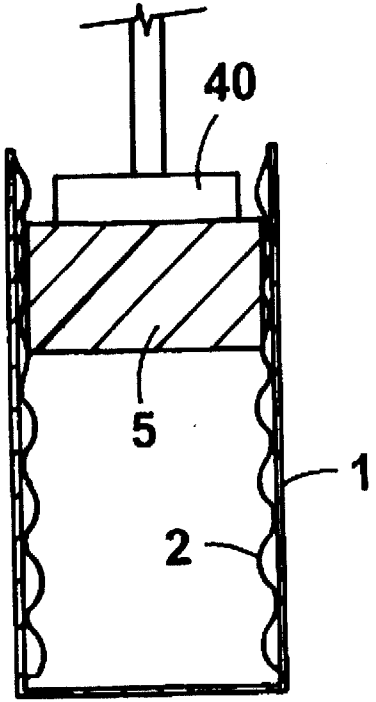

FIGS. 5*a* and 5*b* show other means for handling product to be placed in a container.

FIGS. 1 and 2 show a container 1 of the invention, said container being of cylindrical shape with a circular cross-section. As a characteristic feature, it is equipped inside with five corrugated flat springs 2. Said springs 2 are welded at 3 to said container 1. At the bottom of said container 1, they are joined together by a free torus 4. Their corrugations extend lengthwise along the axial wall 1' of said container 1. The products stored inside said container 1 are represented schematically by 5.

The filling of a container 1 of the invention, characteristically equipped with five corrugated flat springs 2, is now described with reference to FIGS. 3*a* to 3*f*. Said container 1 is destined to be filled with blocks of radioactive compacted waste 5 or cakes 5. Said container 1 is of the type shown in FIGS. 1 and 2.

Said blocks of waste 5, which come from the press, are first placed on a cylindrical rotating plate 21 with a slot (through-slot).

Figures 3A, 3B, 3C, 3D, 3E, 3F:
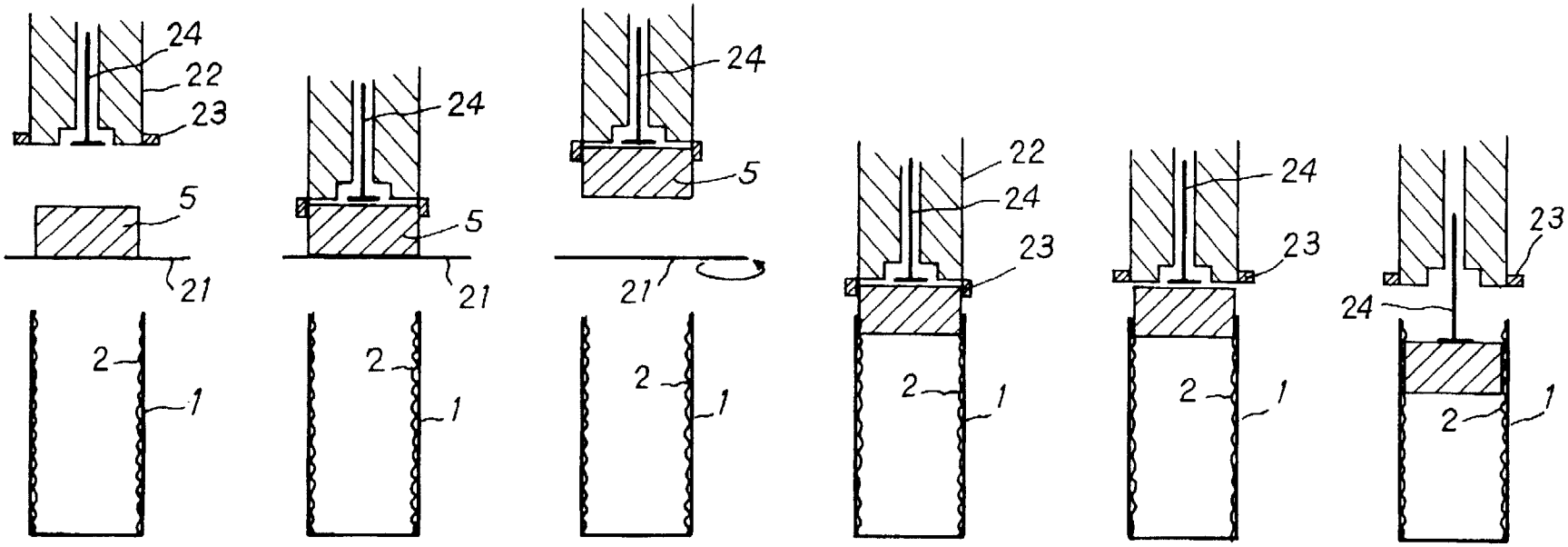

The HLC-type container 1 is placed underneath said rotating plate 21. It rests on the jack of a lift truck (not shown) (FIG. 3*a*).

The blocks of compacted waste 5 are introduced into the container 1 from a grabbing hoist. Said hoist consists inter alia of a grabbing head 22, which measures the height h' of the block of compacted waste 5, grabs said block of waste 5 and pushes it into the container 1. This head comprises:

a main frame with guiding rollers, providing a first vertical translation called "translation no. 1" (FIGS. 3*b* to 3*e*);

a device with three elastic jaws 23 for clamping the blocks of compacted waste 5, with concentric displacement by means of a cam;

a ram 24 providing a vertical thrust on the blocks of compacted waste 5 introduced partially into the container 1, and incorporating an elastic force limiter with a sensor, said vertical thrust or second vertical translation being called "translation no. 2" (FIG. 3*f*); and a set of feelers for the blocks of compacted waste 5 (or cakes), with a sensor.

At the start of a cycle for introducing a block of compacted waste 5 into the container 1, the grabbing head 22 is in the raised position and the rotating plate 21 positions said block of compacted waste 5 by rotation, placing it in the axis of said grabbing head 22 (FIG. 3*a*).

Said grabbing head 22 is then lowered by the system "translation no. 1" until its set of feelers makes contact with the block of compacted waste 5, thereby identifying the presence of said block of waste 5. The sensor, coupled with a synchroresolver, measures the height h' of the block of waste 5. The three elastic jaws of the clamping device 23 then grab the block of waste 5 over a certain height (FIG. 3*b*).

The grabbing head 22 is raised by the system "translation no. 1". The rotating plate 21 rotates until its through-slot is underneath said head 22, thereby giving free access to the container 1, which is located underneath said rotating plate 21 and in the axis of the head 22 (FIG. 3*c*).

The grabbing head 22, together with the block of compacted waste 5, is then lowered again by the system "translation no. 1" to a predefined height and introduces said block of compacted waste 5 partially into the container 1 along its longitudinal axis (FIG. 3*d*).

The three clamping jaws of the clamping device 23 then release the block of compacted waste 5 and the ram 24 completes the introduction of said block of waste 5 into the container 1, to a constant level, by lowering of the system "translation no. 2" (FIGS. 3*e* and 3*f*). (Said block of waste is driven in sufficiently to free the mouth of the container 1 so as to allow the partial introduction of the next block of waste by the same process; its height h' and its diameter d are obviously sufficient to prevent it from falling inside said container 1 under gravity.)

The systems "translation no. 1" and "translation no. 2" then return to the raised position, ready for a new cycle (introduction of the next block of waste).

When the filling of the container 1 has ended, the grabbing hoist measures the space still available in said container 1 by means of the set of feelers and the ram 24, within the clearance limit of the latter.

Said FIGS. 3*a* to 3*f* illustrate a variant of the process of the invention in which the blocks of waste 5 are:

a) initially introduced partially into the container 1 by handling means 23;

b) and then positioned inside the container 1 in several stages. They progressively descend (as a stack) to their final storage position under the successive thrusts of the ram 24.

The invention is further illustrated by the Example below.

An HLC has a hoop at the top (the internal diameter of the flange of the hoop is 400 mm) and a useful height of about 1 m. It is used for storing compacted nuclear waste (cakes resulting from the compaction of shells and end-pieces in a case). Said container is equipped with locking means according to the invention. The purpose of said means is to lock the blocks of compacted waste during the filling stage, when no thrust is exerted on the last block of waste introduced, and during the HLC handling and transportation stages. Said means also protect the container's inner envelope during these two stages of its use.

Said locking means consist of five corrugated flat springs held in the vertical position along the inner wall of the HLC. They are uniformly spaced out around the hoop at 72° intervals (the stored blocks of waste are thus perfectly centered). Each of said springs is welded to the hoop at the top of the HLC. The five springs are joined together by a free torus at the bottom of the HLC.

Each of said springs has the following characteristics:

Geometry:

Length with container empty=slightly less than the useful height of the container;

Width=20 mm;

Thickness=2 mm;

Material:

Stainless steel (because of the nature of the waste): Z 12 CN 18-10;

This parameter governs the mechanical characteristics of the springs;

Corrugations:

The corrugations are arranged over the length of the spring;

Number of corrugations=13;

Pitch of a corrugation when container is empty=78.5 mm;

Amplitude of a corrugation when container is empty=21 mm;

Normal force per corrugation for an amplitude of 15.5 mm=80 daN.

In particular, this container can be filled according to the second variant of the process of the invention, specified above and illustrated with reference to FIGS. 3*a* to 3*f*. To prevent the first block of compacted waste from falling inside the HLC under gravity, said block of waste must have a height h' which is greater than $h'_{minimum}$ (in the present case–cylindrical container and block of waste of circular cross-section–$h'_{mimimum}=\sqrt{D^2-d^2}$, D representing the internal diameter of the HLC and d the diameter of the block of waste).

In other embodiments, the corrugated flat springs 2 (FIGS. 1 and 2) may be replaced with spring elements 30 (FIG. 4), and the clamping device 23 (FIGS. 3*a*–3*f*) may be replaced with other handling means, including an electromagnet 40 (FIG. 5*a*) or a sucker 42 (FIG. 5*b*).

What is claimed is:

1. A packaging and storage container having at least one axial wall of height h, and an end open in order to be filled at its upper axial end, and which is particularly suitable for the confined packaging and storage of remote-handled hazardous waste, said container being equipped inside, along its said at least one axial wall, over substantially the whole of its height h, with locking means capable of undergoing elastic radial deformation on direct contact with the products introduced therein, said locking means allowing the introduction and movement of said products inside said container only when force is applied to said products.

2. A container according to claim 1 wherein said locking means are uniformly distributed over the inner face of its said at least one axial wall.

3. A container according to claim 1 wherein said locking means consist of corrugated flat springs whose corrugations extend over their length and which are held in a substantially vertical position along said at least one axial wall of said container.

4. A container according to claim 3 wherein said locking means consist of at least two corrugated flat springs whose length corresponds to the filling height of said container.

5. A container according to claim 4 wherein said corrugated flat springs are fixed at the top of said container.

6. A container according to claim 4 wherein said corrugated flat springs are joined together by a free torus at the bottom of said container.

7. A container according to claim 4 wherein said locking means consist of at least three corrugated flat springs whose length corresponds to the filling height of said container.

8. A container according to claim 7 wherein said corrugated flat springs are fixed at the top of said container.

9. A container according to claim 7 wherein said corrugated flat springs are joined together by a free torus at the bottom of said container.

10. A container according to claim 1 wherein said locking means consists of spring elements.

11. A container according to claim 1 wherein said container has a cylindrical shape.

12. A container according to claim 1 wherein said container has a prismatic shape.

13. A container according to claim 1 and further comprising a removable lid for said open upper axial end.

14. A process for filling a container according to claim 1 with products which have a shape corresponding to that of the container, and a height h' which is less than or equal to the height h of said container, said process comprising:

handling said products with handling means; and introducing them into said container and positioning them therein by the application of force using said handling means, if necessary in cooperation with complementary means, the force developed being sufficient to overcome the frictional forces exerted by the locking means.

15. A process according to claim 14 wherein said products are handled with handling means which can be introduced into the container, the first of said products being positioned directly at the bottom of said container and any further product then being positioned successively in the same manner.

16. A process according to claim 14 wherein said products are handled with handling means and positioned in several stages, each of them first being introduced partially into the container with said handling means, and then separated from said means and subjected to the action of a ram in order to be introduced completely into said container, said ram pushing each of said products into its final position in said container.

17. A process according to claim 14 wherein said products are handled with handling means and positioned in several stages, each of them first being introduced partially into the container with said handling means, and then separated from said means and subjected to the action of a ram in order to be introduced completely into said container, said ram pushing each of said products, and, where appropriate, product introduced before it, only a short distance which is sufficient to free the mouth of said container.

18. Implementing the process of claim 14 for packaging and storing compacted nuclear waste.

19. A process according to claim 14 wherein said handling means comprise clamps.

20. A process according to claim 14 wherein said handling means comprise suckers.

21. A process according to claim 14 wherein said handling means comprise electromagnets.

* * * * *